US010408206B2

(12) United States Patent
Mills

(10) Patent No.: US 10,408,206 B2
(45) Date of Patent: Sep. 10, 2019

(54) METHODS AND APPARATUS TO DETERMINE PARAMETERS OF A PUMPING UNIT FOR USE WITH WELLS

(71) Applicant: Bristol, Inc., Watertown, CT (US)

(72) Inventor: Thomas Matthew Mills, Katy, TX (US)

(73) Assignee: BRISTOL, INC., Houston, TX (US)

( * ) Notice: Subject to any disclaimer, the term of this patent is extended or adjusted under 35 U.S.C. 154(b) by 770 days.

(21) Appl. No.: 14/321,543

(22) Filed: Jul. 1, 2014

(65) Prior Publication Data

US 2016/0003234 A1 Jan. 7, 2016

(51) Int. Cl.

| | |
|---|---|
| ***E21B 43/12*** | (2006.01) |
| ***F04B 47/00*** | (2006.01) |
| ***F04B 47/02*** | (2006.01) |
| ***F04B 47/14*** | (2006.01) |
| ***F04B 49/06*** | (2006.01) |

(52) U.S. Cl.

CPC ..... *F04B 47/14* (2013.01); *E21B 43/126* (2013.01); *F04B 47/00* (2013.01); *F04B 47/02* (2013.01); *F04B 47/022* (2013.01); *F04B 49/065* (2013.01); *F04B 2201/121* (2013.01); *F04B 2201/1202* (2013.01); *F04B 2201/1211* (2013.01)

(58) Field of Classification Search

CPC ..... F04B 47/14; F04B 47/022; F04B 47/02; F04B 2201/121; F04B 2201/1211; F04B 2201/1202; E21B 43/125; E21B 43/126

See application file for complete search history.

(56) References Cited

U.S. PATENT DOCUMENTS

| | | | | |
|---|---|---|---|---|
| 3,029,650 | A | 4/1962 | Byrd | |
| 3,765,234 | A | 10/1973 | Sievert | |
| 4,483,188 | A | 11/1984 | McTamaney et al. | |
| 4,490,094 | A * | 12/1984 | Gibbs | F04B 47/02 417/42 |
| 4,541,274 | A * | 9/1985 | Purcupile | E21B 47/0008 166/105 |

(Continued)

FOREIGN PATENT DOCUMENTS

| | | |
|---|---|---|
| CA | 2744324 | 12/2012 |
| RU | 2334897 | 9/2008 |
| RU | 2008118534 | 11/2009 |

OTHER PUBLICATIONS

Gobor Takacs, "Calculation of Gearbox Torques Considering Inertial Effects", 2012.*

(Continued)

*Primary Examiner* — Christopher S Bobish

(74) *Attorney, Agent, or Firm* — Hanley, Flight & Zimmerman, LLC

(57) ABSTRACT

Methods and apparatus to determine parameters of a pumping unit for use with wells are disclosed. An example apparatus includes a housing and a processor positioned in the housing. The processor is to determine a first load on a polished rod of a pumping unit, to estimate a first torque of a motor of the pumping unit, and determine a first torque factor for the pumping unit. The processor is to, based on the first load, the first torque, and the first torque factor, determine a phase angle of a counterbalance of the pumping unit or a moment of the counterbalance.

21 Claims, 14 Drawing Sheets

(56) References Cited

U.S. PATENT DOCUMENTS

| | | | | |
|---|---|---|---|---|
| 4,661,751 | A | 4/1987 | Werner | |
| 5,204,595 | A | 4/1993 | Opal et al. | |
| 5,291,777 | A | 3/1994 | Chang et al. | |
| 6,343,656 | B1 * | 2/2002 | Vazquez | E21B 47/0008 166/373 |
| 7,547,196 | B2 | 6/2009 | Boyer et al. | |
| 8,240,221 | B2 * | 8/2012 | Simpson | F04B 47/02 166/105.2 |
| 8,444,393 | B2 * | 5/2013 | Beck | E21B 43/126 417/53 |
| 9,115,574 | B2 * | 8/2015 | Doyle | E21B 43/127 |
| 2004/0084179 | A1 | 5/2004 | Watson et al. | |
| 2005/0095140 | A1 | 5/2005 | Boren et al. | |
| 2006/0060011 | A1 | 3/2006 | Jensen | |
| 2006/0067834 | A1 | 3/2006 | Boyer et al. | |
| 2012/0020808 | A1 | 1/2012 | Lawson et al. | |
| 2013/0030721 | A1 | 1/2013 | Palka et al. | |
| 2014/0129037 | A1 * | 5/2014 | Peterson | F04B 47/022 700/282 |
| 2016/0003236 | A1 | 1/2016 | Mills | |
| 2016/0131128 | A1 * | 5/2016 | Doyle | E21B 43/127 74/36 |

OTHER PUBLICATIONS

Patent Cooperation Treaty, "International Preliminary Report on Patentability," issued in connection with PCT Patent Application No. PCT/US2015/038731, dated Jan. 3, 2017, 9 pages.

Patent Cooperation Treaty, "International Preliminary Report on Patentability," issued in connection with PCT Patent Application No. PCT/US2015/038726, dated Jan. 3, 2017, 7 pages.

SPOC Automation, "IronHorse Series Drive, 40 HP, 480VAC, 3 phase Air Balance Pumping Unit," video accessed on Internet on Jul. 1, 2014, https://www.facebook.com/video/video.php?v=209887075805037, 1 page.

Patent Cooperation Treaty, "International Search Report", issued in connection with PCT Patent Application No. PCT/US2015/038726, dated Dec. 10, 2015, 5 pages.

Patent Cooperation Treaty, "Written Opinion", issued in connection with PCT Patent Application No. PCT/US2015/038726, dated Dec. 10, 2015, 6 pages.

Patent Cooperation Treaty, "Communication Relating to the Results of the Partial International Search," issued in connection with PCT Patent Application No. PCT/US2015/038731, dated Dec. 17, 2015, 4 pages.

Patent Cooperation Treaty, "International Search Report," issued in connection with PCT Patent Application No. PCT/US2015/038731, dated Feb. 22, 2016, 7 pages.

Patent Cooperation Treaty, "Written Opinion," issued in connection with PCT Patent Application No. PCT/US2015/038731, dated Feb. 22, 2016, 8 pages.

United States Patent and Trademark Office, "Non-Final Office Action," issued in connection with U.S. Appl. No. 14/321,528, dated Jan. 13, 2017, 50 pages.

SPOC Automation, "IronHorse Series Drive, 40 HP, 480VAC, 3 phase Air Balance Pumping Unit," retrieved on Jan. 17, 2017, [https://www.facebook.com/video/video.php?v=209887075805037], 2 pages.

United States Patent and Trademark Office, "Non-Final Office Action," issued in connection with U.S. Appl. No. 14/321,528, dated Feb. 6, 2018, 22 pages.

Takacs, Gabor, "Modern Sucker-Rod Pumping," PennWell Publishing, Tulsa, OK, 1993, pp. 80-91, 14 pages.

United States Patent and Trademark Office, "Notice of Allowance," issued in connection with U.S. Appl. No. 14/321,528, dated Jun. 5, 2018, 13 pages.

Federal Service for Intellectual Property, "Office Action," issued in connection with Russian Patent Application No. 20171022021/06(003493), dated Jan. 24, 2019, 13 pages.

* cited by examiner

400

| 402 TIME [SECS] | 404 MOTOR PULSE COUNT | 406 POSITION [INCH] | 402 TIME [SECS] | 404 MOTOR PULSE COUNT | 406 POSITION [INCH] | 402 TIME [SECS] | 404 MOTOR PULSE COUNT | 406 POSITION [INCH] | 402 TIME [SECS] | 404 MOTOR PULSE COUNT | 406 POSITION [INCH] |
|---|---|---|---|---|---|---|---|---|---|---|---|
| 0 | 0 | 12.59 | 2.05 | 237 | 74.58 | 4.05 | 458 | 72.19 | 6.05 | 698 | 11.42 |
| 0.05 | 6 | 13.81 | 2.1 | 243 | 75.70 | 4.1 | 464 | 70.93 | 6.1 | 704 | 10.30 |
| 0.1 | 12 | 15.07 | 2.15 | 249 | 76.77 | 4.15 | 470 | 69.62 | 6.15 | 710 | 9.23 |
| 0.15 | 18 | 16.38 | 2.2 | 255 | 77.79 | 4.2 | 476 | 68.27 | 6.2 | 716 | 8.21 |
| 0.2 | 24 | 17.73 | 2.25 | 261 | 78.75 | 4.25 | 482 | 66.89 | 6.25 | 722 | 7.25 |
| 0.25 | 30 | 19.11 | 2.3 | 267 | 79.66 | 4.3 | 488 | 65.47 | 6.3 | 728 | 6.34 |
| 0.3 | 36 | 20.53 | 2.35 | 273 | 80.52 | 4.35 | 494 | 64.01 | 6.35 | 734 | 5.48 |
| 0.35 | 42 | 21.99 | 2.4 | 279 | 81.31 | 4.4 | 500 | 62.52 | 6.4 | 740 | 4.69 |
| 0.4 | 48 | 23.48 | 2.45 | 285 | 82.05 | 4.45 | 506 | 61.00 | 6.45 | 746 | 3.95 |
| 0.45 | 54 | 25.00 | 2.5 | 291 | 82.73 | 4.5 | 512 | 59.46 | 6.5 | 752 | 3.27 |
| 0.5 | 60 | 26.54 | 2.55 | 297 | 83.34 | 4.55 | 518 | 57.88 | 6.55 | 758 | 2.66 |
| 0.55 | 66 | 28.12 | 2.6 | 303 | 83.90 | 4.6 | 524 | 56.29 | 6.6 | 764 | 2.10 |
| 0.6 | 72 | 29.71 | 2.65 | 309 | 84.39 | 4.65 | 530 | 54.67 | 6.65 | 770 | 1.61 |
| 0.65 | 78 | 31.33 | 2.7 | 315 | 84.81 | 4.7 | 536 | 53.04 | 6.7 | 776 | 1.19 |
| 0.7 | 84 | 32.96 | 2.75 | 321 | 85.17 | 4.75 | 542 | 51.39 | 6.75 | 782 | 0.83 |
| 0.75 | 90 | 34.61 | 2.8 | 327 | 85.47 | 4.8 | 548 | 49.73 | 6.8 | 788 | 0.53 |
| 0.8 | 96 | 36.27 | 2.85 | 333 | 85.70 | 4.85 | 554 | 48.05 | 6.85 | 794 | 0.30 |
| 0.85 | 102 | 37.95 | 2.9 | 339 | 85.87 | 4.9 | 560 | 46.37 | 6.9 | 800 | 0.13 |
| 0.9 | 108 | 39.63 | 2.95 | 344 | 85.97 | 4.95 | 566 | 44.69 | 6.95 | 806 | 0.03 |
| 0.95 | 114 | 41.31 | 3 | 349 | 86.00 | 5 | 572 | 43.00 | 7 | 812 | 0.00 |
| 1 | 119 | 43.00 | 3.05 | 354 | 85.97 | 5.05 | 578 | 41.31 | 7.05 | 818 | 0.03 |

408 410 412 420 414 416 417 418

FIG. 4A

| | | |
|---|---|---|
| 1.05 | 124 | 44.69 |
| 1.1 | 129 | 46.37 |
| 1.15 | 134 | 48.05 |
| 1.2 | 139 | 49.73 |
| 1.25 | 144 | 51.39 |
| 1.3 | 149 | 53.04 |
| 1.35 | 154 | 54.67 |
| 1.4 | 159 | 56.29 |
| 1.45 | 165 | 57.88 |
| 1.5 | 171 | 59.46 |
| 1.55 | 177 | 61.00 |
| 1.6 | 183 | 62.52 |
| 1.65 | 189 | 64.01 |
| 1.7 | 195 | 65.47 |
| 1.75 | 201 | 66.89 |
| 1.8 | 207 | 68.27 |
| 1.85 | 213 | 69.62 |
| 1.9 | 219 | 70.93 |
| 1.95 | 225 | 72.19 |
| 2 | 231 | 73.41 |

| | | |
|---|---|---|
| 3.1 | 359 | 85.87 |
| 3.15 | 364 | 85.70 |
| 3.2 | 369 | 85.47 |
| 3.25 | 374 | 85.17 |
| 3.3 | 379 | 84.81 |
| 3.35 | 384 | 84.39 |
| 3.4 | 389 | 83.90 |
| 3.45 | 394 | 83.34 |
| 3.5 | 399 | 82.73 |
| 3.55 | 404 | 82.05 |
| 3.6 | 409 | 81.31 |
| 3.65 | 414 | 80.52 |
| 3.7 | 419 | 79.66 |
| 3.75 | 424 | 78.75 |
| 3.8 | 429 | 77.79 |
| 3.85 | 434 | 76.77 |
| 3.9 | 440 | 75.70 |
| 3.95 | 446 | 74.58 |
| 4 | 452 | 73.41 |

| | | |
|---|---|---|
| 5.1 | 584 | 39.63 |
| 5.15 | 590 | 37.95 |
| 5.2 | 596 | 36.27 |
| 5.25 | 602 | 34.61 |
| 5.3 | 608 | 32.96 |
| 5.35 | 614 | 31.33 |
| 5.4 | 620 | 29.71 |
| 5.45 | 626 | 28.12 |
| 5.5 | 632 | 26.54 |
| 5.55 | 638 | 25.00 |
| 5.6 | 644 | 23.48 |
| 5.65 | 650 | 21.99 |
| 5.7 | 656 | 20.53 |
| 5.75 | 662 | 19.11 |
| 5.8 | 668 | 17.73 |
| 5.85 | 674 | 16.38 |
| 5.9 | 680 | 15.07 |
| 5.95 | 686 | 13.81 |
| 6 | 692 | 12.59 |

| | | |
|---|---|---|
| 7.1 | 824 | 0.13 |
| 7.15 | 830 | 0.30 |
| 7.2 | 836 | 0.53 |
| 7.25 | 842 | 0.83 |
| 7.3 | 848 | 1.19 |
| 7.35 | 854 | 1.61 |
| 7.4 | 860 | 2.10 |
| 7.45 | 866 | 2.66 |
| 7.5 | 872 | 3.27 |
| 7.55 | 878 | 3.95 |
| 7.6 | 884 | 4.69 |
| 7.65 | 890 | 5.48 |
| 7.7 | 896 | 6.34 |
| 7.75 | 902 | 7.25 |
| 7.8 | 908 | 8.21 |
| 7.85 | 914 | 9.23 |
| 7.9 | 920 | 10.30 |
| 7.95 | 926 | 11.42 |
| 8 | 932 | 12.59 |

FIG. 4B

500

| 502 TIME [SECS] | 504 RAW MOTOR PULSE COUNT | 506 POSITION [INCH] | 508 CRANK ANGLE [RADIANS] | 502 TIME [SECS] | 504 RAW MOTOR PULSE COUNT | 506 POSITION [INCH] | 508 CRANK ANGLE [RADIANS] | 502 TIME [SECS] | 504 RAW MOTOR PULSE COUNT | 506 POSITION [INCH] | 508 CRANK ANGLE [RADIANS] | 502 TIME [SECS] | 504 RAW MOTOR PULSE COUNT | 506 POSITION [INCH] | 508 CRANK ANGLE [RADIANS] |
|---|---|---|---|---|---|---|---|---|---|---|---|---|---|---|---|
| 6.9 | 800 | 0.13 | 0.00 | 0.9 | 108 | 39.63 | 1.62 | 2.9 | 339 | 85.87 | 3.18 | 4.9 | 560 | 46.37 | 4.6652 |
| 6.95 | 806 | 0.03 | 0.04 | 0.95 | 114 | 41.31 | 1.66 | 2.95 | 344 | 85.97 | 3.21 | 4.95 | 566 | 44.69 | 4.7056 |
| 7 | 812 | 0.00 | 0.08 | 1 | 119 | 43.00 | 1.69 | 3 | 349 | 86.00 | 3.24 | 5 | 572 | 43.00 | 4.7461 |
| 7.05 | 818 | 0.03 | 0.12 | 1.05 | 124 | 44.69 | 1.73 | 3.05 | 354 | 85.97 | 3.28 | 5.05 | 578 | 41.31 | 4.7865 |
| 7.1 | 824 | 0.13 | 0.16 | 1.1 | 129 | 46.37 | 1.76 | 3.1 | 359 | 85.87 | 3.31 | 5.1 | 584 | 39.63 | 4.827 |
| 7.15 | 830 | 0.30 | 0.20 | 1.15 | 134 | 48.05 | 1.79 | 3.15 | 364 | 85.70 | 3.34 | 5.15 | 590 | 37.95 | 4.8674 |
| 7.2 | 836 | 0.53 | 0.24 | 1.2 | 139 | 49.73 | 1.83 | 3.2 | 369 | 85.47 | 3.38 | 5.2 | 596 | 36.27 | 4.9079 |
| 7.25 | 842 | 0.83 | 0.28 | 1.25 | 144 | 51.39 | 1.86 | 3.25 | 374 | 85.17 | 3.41 | 5.25 | 602 | 34.61 | 4.9483 |
| 7.3 | 848 | 1.19 | 0.32 | 1.3 | 149 | 53.04 | 1.89 | 3.3 | 379 | 84.81 | 3.44 | 5.3 | 608 | 32.96 | 4.9888 |
| 7.35 | 854 | 1.61 | 0.36 | 1.35 | 154 | 54.67 | 1.93 | 3.35 | 384 | 84.39 | 3.48 | 5.35 | 614 | 31.33 | 5.0292 |
| 7.4 | 860 | 2.10 | 0.40 | 1.4 | 159 | 56.29 | 1.96 | 3.4 | 389 | 83.90 | 3.51 | 5.4 | 620 | 29.71 | 5.0697 |
| 7.45 | 866 | 2.66 | 0.44 | 1.45 | 165 | 57.88 | 2.00 | 3.45 | 394 | 83.34 | 3.55 | 5.45 | 626 | 28.12 | 5.1101 |
| 7.5 | 872 | 3.27 | 0.49 | 1.5 | 171 | 59.46 | 2.04 | 3.5 | 399 | 82.73 | 3.58 | 5.5 | 632 | 26.54 | 5.1506 |
| 7.55 | 878 | 3.95 | 0.53 | 1.55 | 177 | 61.00 | 2.08 | 3.55 | 404 | 82.05 | 3.61 | 5.55 | 638 | 25.00 | 5.191 |
| 7.6 | 884 | 4.69 | 0.57 | 1.6 | 183 | 62.52 | 2.12 | 3.6 | 409 | 81.31 | 3.65 | 5.6 | 644 | 23.48 | 5.2315 |
| 7.65 | 890 | 5.48 | 0.61 | 1.65 | 189 | 64.01 | 2.16 | 3.65 | 414 | 80.52 | 3.68 | 5.65 | 650 | 21.99 | 5.2719 |
| 7.7 | 896 | 6.34 | 0.65 | 1.7 | 195 | 65.47 | 2.20 | 3.7 | 419 | 79.66 | 3.71 | 5.7 | 656 | 20.53 | 5.3124 |
| 7.75 | 902 | 7.25 | 0.69 | 1.75 | 201 | 66.89 | 2.24 | 3.75 | 424 | 78.75 | 3.75 | 5.75 | 662 | 19.11 | 5.3528 |
| 7.8 | 908 | 8.21 | 0.73 | 1.8 | 207 | 68.27 | 2.29 | 3.8 | 429 | 77.79 | 3.78 | 5.8 | 668 | 17.73 | 5.3933 |

514 520 512 518 510 516

FIG. 5A

| | | | | | | | | | | | | | | | |
|---|---|---|---|---|---|---|---|---|---|---|---|---|---|---|---|
| 7.85 | 914 | 9.23 | 0.77 | 1.85 | 213 | 69.62 | 2.33 | 3.85 | 434 | 76.77 | 3.82 | 5.85 | 674 | 16.38 | 5.4337 |
| 7.9 | 920 | 10.30 | 0.81 | 1.9 | 219 | 70.93 | 2.37 | 3.9 | 440 | 75.70 | 3.86 | 5.9 | 680 | 15.07 | 5.4742 |
| 7.95 | 926 | 11.42 | 0.85 | 1.95 | 225 | 72.19 | 2.41 | 3.95 | 446 | 74.58 | 3.90 | 5.95 | 686 | 13.81 | 5.5146 |
| 8 | 932 | 12.59 | 0.89 | 2 | 231 | 73.41 | 2.45 | 4 | 452 | 73.41 | 3.94 | 6 | 692 | 12.59 | 5.5551 |
| 0 | 0 | 12.59 | 0.89 | 2.05 | 237 | 74.58 | 2.49 | 4.05 | 458 | 72.19 | 3.98 | 6.05 | 698 | 11.42 | 5.5955 |
| 0.05 | 6 | 13.81 | 0.93 | 2.1 | 243 | 75.70 | 2.53 | 4.1 | 464 | 70.93 | 4.02 | 6.1 | 704 | 10.30 | 5.636 |
| 0.1 | 12 | 15.07 | 0.97 | 2.15 | 249 | 76.77 | 2.57 | 4.15 | 470 | 69.62 | 4.06 | 6.15 | 710 | 9.23 | 5.6764 |
| 0.15 | 18 | 16.38 | 1.01 | 2.2 | 255 | 77.79 | 2.61 | 4.2 | 476 | 68.27 | 4.10 | 6.2 | 716 | 8.21 | 5.7169 |
| 0.2 | 24 | 17.73 | 1.05 | 2.25 | 261 | 78.75 | 2.65 | 4.25 | 482 | 66.89 | 4.14 | 6.25 | 722 | 7.25 | 5.7573 |
| 0.25 | 30 | 19.11 | 1.09 | 2.3 | 267 | 79.66 | 2.69 | 4.3 | 488 | 65.47 | 4.18 | 6.3 | 728 | 6.34 | 5.7978 |
| 0.3 | 36 | 20.53 | 1.13 | 2.35 | 273 | 80.52 | 2.73 | 4.35 | 494 | 64.01 | 4.22 | 6.35 | 734 | 5.48 | 5.8382 |
| 0.35 | 42 | 21.99 | 1.17 | 2.4 | 279 | 81.31 | 2.77 | 4.4 | 500 | 62.52 | 4.26 | 6.4 | 740 | 4.69 | 5.8787 |
| 0.4 | 48 | 23.48 | 1.21 | 2.45 | 285 | 82.05 | 2.81 | 4.45 | 506 | 61.00 | 4.30 | 6.45 | 746 | 3.95 | 5.9191 |
| 0.45 | 54 | 25.00 | 1.25 | 2.5 | 291 | 82.73 | 2.85 | 4.5 | 512 | 59.46 | 4.34 | 6.5 | 752 | 3.27 | 5.9596 |
| 0.5 | 60 | 26.54 | 1.29 | 2.55 | 297 | 83.34 | 2.89 | 4.55 | 518 | 57.88 | 4.38 | 6.55 | 758 | 2.66 | 6 |
| 0.55 | 66 | 28.12 | 1.33 | 2.6 | 303 | 83.90 | 2.93 | 4.6 | 524 | 56.29 | 4.42 | 6.6 | 764 | 2.10 | 6.0405 |
| 0.6 | 72 | 29.71 | 1.38 | 2.65 | 309 | 84.39 | 2.97 | 4.65 | 530 | 54.67 | 4.46 | 6.65 | 770 | 1.61 | 6.0809 |
| 0.65 | 78 | 31.33 | 1.42 | 2.7 | 315 | 84.81 | 3.01 | 4.7 | 536 | 53.04 | 4.50 | 6.7 | 776 | 1.19 | 6.1214 |
| 0.7 | 84 | 32.96 | 1.46 | 2.75 | 321 | 85.17 | 3.05 | 4.75 | 542 | 51.39 | 4.54 | 6.75 | 782 | 0.83 | 6.1618 |
| 0.75 | 90 | 34.61 | 1.50 | 2.8 | 327 | 85.47 | 3.09 | 4.8 | 548 | 49.73 | 4.58 | 6.8 | 788 | 0.53 | 6.2023 |
| 0.8 | 96 | 36.27 | 1.54 | 2.85 | 333 | 85.70 | 3.13 | 4.85 | 554 | 48.05 | 4.62 | 6.85 | 794 | 0.30 | 6.2427 |
| 0.85 | 102 | 37.95 | 1.58 | | | | | | | | | | | | |

FIG. 5B

600

| 502 TIME | 504 RAW MOTOR PULSE | 506 POSITION | 508 CRANK ANGLE | 602 ds/dt | 604 d(THETA)/dt | 606 ds/d(THETA) |
|---|---|---|---|---|---|---|
| [SECS] | COUNT | [INCH] | [RADIANS] | [IN/SEC] | RAD/SEC | IN |
| 6.9 | 800 | 0.13 | 0.00 | | | |
| 6.95 | 806 | 0.03 | 0.04 | -1.33 | 0.81 | -1.64 |
| 7 | 812 | 0.00 | 0.08 | 0.00 | 0.81 | 0.00 |
| 7.05 | 818 | 0.03 | 0.12 | 1.33 | 0.81 | 1.64 |
| 7.1 | 824 | 0.13 | 0.16 | 2.65 | 0.81 | 3.27 |
| 7.15 | 830 | 0.30 | 0.20 | 3.97 | 0.81 | 4.91 |
| 7.2 | 836 | 0.53 | 0.24 | 5.28 | 0.81 | 6.53 |
| 7.25 | 842 | 0.83 | 0.28 | 6.59 | 0.81 | 8.14 |
| 7.3 | 848 | 1.19 | 0.32 | 7.88 | 0.81 | 9.74 |
| 7.35 | 854 | 1.61 | 0.36 | 9.16 | 0.81 | 11.33 |
| 7.4 | 860 | 2.10 | 0.40 | 10.43 | 0.81 | 12.90 |
| 7.45 | 866 | 2.66 | 0.44 | 11.69 | 0.81 | 14.45 |
| 7.5 | 872 | 3.27 | 0.49 | 12.92 | 0.81 | 15.97 |
| 7.55 | 878 | 3.95 | 0.53 | 14.14 | 0.81 | 17.47 |
| 7.6 | 884 | 4.69 | 0.57 | 15.33 | 0.81 | 18.95 |
| 7.65 | 890 | 5.48 | 0.61 | 16.50 | 0.81 | 20.39 |
| 7.7 | 896 | 6.34 | 0.65 | 17.64 | 0.81 | 21.81 |
| 7.75 | 902 | 7.25 | 0.69 | 18.76 | 0.81 | 23.19 |
| 7.8 | 908 | 8.21 | 0.73 | 19.85 | 0.81 | 24.53 |
| 7.85 | 914 | 9.23 | 0.77 | 20.90 | 0.81 | 25.84 |
| 7.9 | 920 | 10.30 | 0.81 | 21.93 | 0.81 | 27.10 |
| 7.95 | 926 | 11.42 | 0.85 | 22.92 | 0.81 | 28.33 |
| 8 | 932 | 12.59 | 0.89 | 23.87 | 0.81 | 29.51 |
| 0.05 | 6 | 13.81 | 0.93 | 24.79 | 0.81 | 30.65 |
| 0.1 | 12 | 15.07 | 0.97 | 25.67 | 0.81 | 31.74 |
| 0.15 | 18 | 16.38 | 1.01 | 26.52 | 0.81 | 32.78 |

608

610

FIG. 6A

| | | | | | | |
|---|---|---|---|---|---|---|
| 0.2 | 24 | 17.73 | 1.05 | 27.32 | 0.81 | 33.76 |
| 0.25 | 30 | 19.11 | 1.09 | 28.07 | 0.81 | 34.70 |
| 0.3 | 36 | 20.53 | 1.13 | 28.79 | 0.81 | 35.59 |
| 0.35 | 42 | 21.99 | 1.17 | 29.46 | 0.81 | 36.41 |
| 0.4 | 48 | 23.48 | 1.21 | 30.08 | 0.81 | 37.19 |
| 0.45 | 54 | 25.00 | 1.25 | 30.66 | 0.81 | 37.90 |
| 0.5 | 60 | 26.54 | 1.29 | 31.19 | 0.81 | 38.56 |
| 0.55 | 66 | 28.12 | 1.33 | 31.68 | 0.81 | 39.16 |
| 0.6 | 72 | 29.71 | 1.38 | 32.11 | 0.81 | 39.69 |
| 0.65 | 78 | 31.33 | 1.42 | 32.50 | 0.81 | 40.17 |
| 0.7 | 84 | 32.96 | 1.46 | 32.83 | 0.81 | 40.58 |
| 0.75 | 90 | 34.61 | 1.50 | 33.11 | 0.81 | 40.93 |
| 0.8 | 96 | 36.27 | 1.54 | 33.35 | 0.81 | 41.22 |
| 0.85 | 102 | 37.95 | 1.58 | | | |

FIG. 6B

METHODS AND APPARATUS TO DETERMINE PARAMETERS OF A PUMPING UNIT FOR USE WITH WELLS

FIELD OF THE DISCLOSURE

This disclosure relates generally to hydrocarbon and/or fluid production and, more particularly, to methods and apparatus to determine parameters of a pumping unit for use with wells.

BACKGROUND

Pumping units are used to extract fluid (e.g., hydrocarbons) from a well. As the pumping unit cycles to extract the fluid from the well, different forces are imparted on the components of the pumping unit.

SUMMARY

An example method includes determining a first load on a polished rod of a pumping unit and estimating a first torque of a motor of the pumping unit. The example method includes determining a first torque factor for the pumping unit, the first torque factor comprises a rate of change in a position of the polished rod with respect to an angle of a crank arm of the pumping unit. The example method includes, based on the first load, the first torque, and the first torque factor, determining a phase angle of a counterbalance of the pumping unit or a moment of the counterbalance.

An example method includes determining a first torque factor of a pumping unit by determining a correlation between pulse count values of a motor using a first sensor and a position of a polished rod using a second sensor. The torque factor includes a rate of change in a position of a polished rod of the pumping unit with respect to an angle of a crank arm of the pumping unit.

An example apparatus includes a housing and a processor positioned in the housing. The processor is to determine a first load on a polished rod of a pumping unit, to estimate a first torque of a motor of the pumping unit, and determine a first torque factor for the pumping unit. The processor is to, based on the first load, the first torque, and the first torque factor, determine a phase angle of a counterbalance of the pumping unit or a moment of the counterbalance.

BRIEF DESCRIPTION OF THE DRAWINGS

FIGS. 4A and 4B show an example reference table generated during an example calibration process in accordance with the teachings of this disclosure.

FIGS. 5A and 5B show another example reference table generated using the examples disclosed herein.

FIGS. 6A and 6B show another example reference table generated using the examples disclosed herein.

The figures are not to scale. Wherever possible, the same reference numbers will be used throughout the drawing(s) and accompanying written description to refer to the same or like parts.

DETAILED DESCRIPTION

As a pumping unit of a well moves through a cycle, forces and/or torques are exerted on the different pumping unit components. In some examples, if at least some of these forces and/or torques are monitored and/or maintained below a particular value, the operating life of the pumping unit and/or its components may be extended. The examples disclosed herein relate to example rod pump controllers and related methods that monitor loads and/or forces imparted on a gear box of a pumping unit in substantially real time. Based on the monitored loads and/or forces, the rod pump controller may cause the pumping unit to be operated such that peak gear box loads are maintained below a predetermined value (e.g., design limit) to extend the operating life of the gear box, for example. Additionally or alternatively, the examples disclosed herein may be used to determine torque factors, counterbalance phase angles and/or counterbalance moments for a pumping unit.

In some examples, a majority of the loads experienced by the gear box are associated with a counterbalance torque and a torque from the polished rod load. The counterbalance torque may be at its minimum (e.g., approximately zero) when the crank arm is vertical and at its maximum when the crank arm is horizontal. In some examples, the polished rod torque may be determined based on the polished rod load and a torque factor(s) that correlates the polished rod load and the polished rod torque.

The torque factors for a pumping unit may be determined in different ways. For example, the torque factors may be determined based on the geometry of the pumping unit and known equations and/or an example calibration process. If the torque factor(s) is determined using the example calibration process and subsequent processing, the torque factor(s) may be determined using finite difference approximation and values determined during the calibration process and/or values subsequently determined. Regardless of how the torque factor(s) is determined, the torque factor(s) may be used to determine the net torque experienced by the gear box, the counterbalance phase angle and/or the maximum counterbalance torque moment. In operation, the pumping unit may be operated to substantially ensure that the net torque experienced by the gear box and/or the counterbalance torque moment are maintained below their maximum(s) and/or a predetermined value(s) to substantially increase the operating life of the pump unit components. Additionally or alternatively, the phase angle and/or pumping unit components may be adjusted to decrease the maximum net torque experienced by the gear box.

Figure 1:
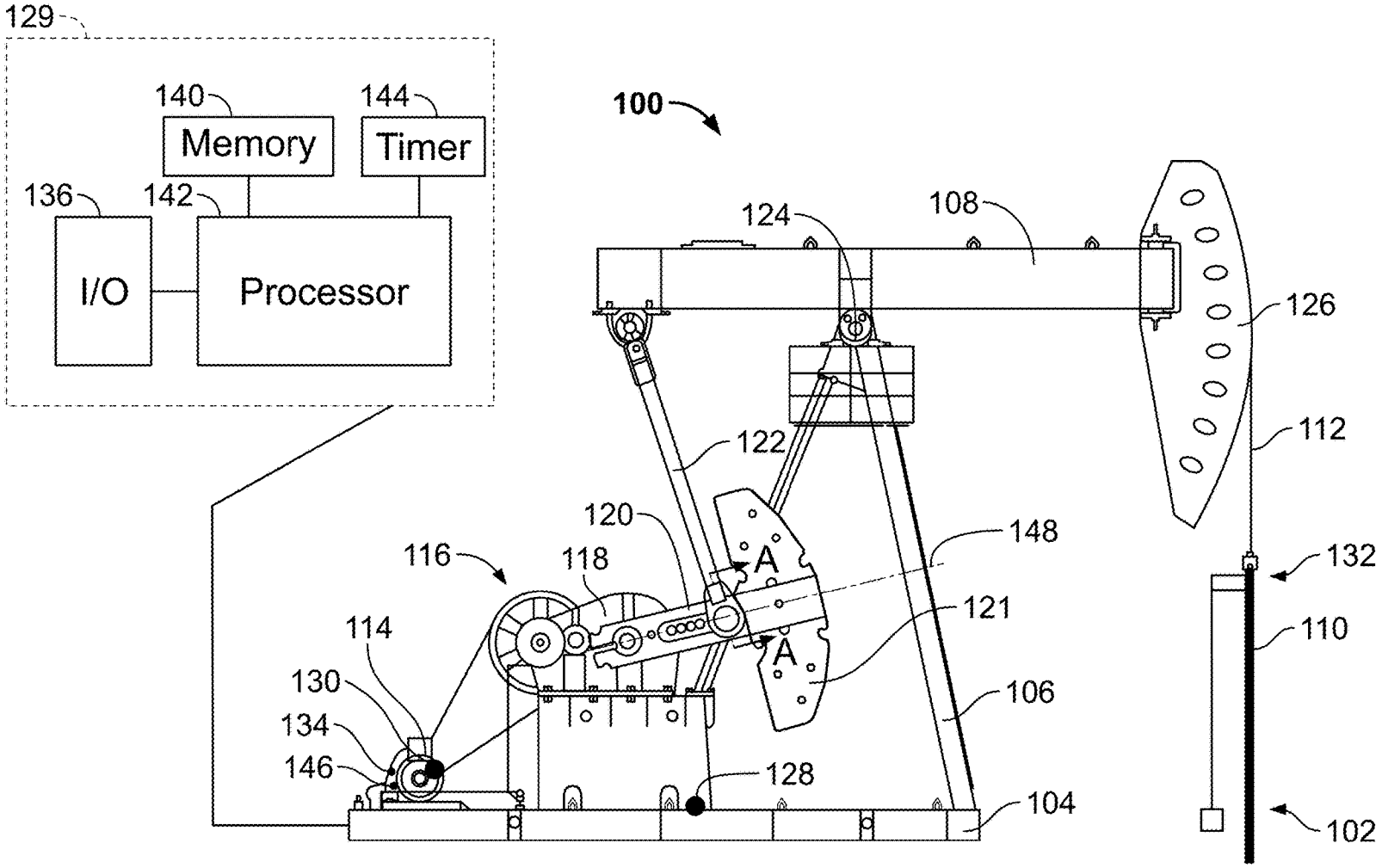
FIG. 1 is an example pumping unit for use with a well on which the examples disclosed herein can be implemented.

FIG. 1 shows an example crank arm balanced pumping unit and/or pumping unit 100 that can be used to produce oil from an oil well 102. The pumping unit 100 includes a base 104, a Sampson post 106 and a walking beam 108. The walking beam 108 may be used to reciprocate a polished rod 110 relative to the oil well 102 via a bridle 112.

The pumping unit 100 includes a motor or engine 114 that drives a belt and sheave system 116 to rotate a gear box 118 and, in turn, rotate a crank arm 120 and a counterweight and/or counterbalance 121. A pitman 122 is coupled between the crank arm 120 and the walking beam 108 such that rotation of the crank arm 120 moves the pitman 122 and the walking beam 108. As the walking beam 108 pivots about a pivot point and/or saddle bearing 124, the walking beam 108 moves a horse head 126 and the polished rod 110.

To detect when the crank arm 120 completes a cycle and/or passes a particular angular position, a first sensor 128 is coupled adjacent to the crank arm 120. To detect and/or monitor a number of revolutions of the motor 114, a second sensor 130 is coupled adjacent the motor 114. A third sensor (e.g., a string potentiometer, a linear displacement sensor using radar, laser, etc.) 132 is coupled to the pumping unit 100 and is used in combination with the first and second sensors (e.g., proximity sensors) 128, 130 to calibrate a rod pump controller and/or apparatus 129 in accordance with the teachings of this disclosure. In contrast to some known calibration techniques that rely on measuring the pumping unit and determining a crank arm/polished rod offset, the example apparatus 129 is calibrated by measuring directly the position of the polished rod 110 and the rotation of the motor 114 throughout a cycle of the crank arm 120.

In some examples, to calibrate the apparatus 129 of FIG. 1, the first sensor 128 detects the completion of a cycle of the crank arm 120, the second sensor 130 detects one or more targets 134 coupled to the motor 114 and/or a shaft of the motor 114 as the motor 114 rotates and the third sensor 132 measures directly the position of the polished rod 110 throughout its stroke. Data obtained from the first, second and third sensors 128, 130 and 132 are received by an input/out (I/O) device 136 of the apparatus 129 and stored in a memory 140 that is accessible by a processor 142 positioned within a housing of the apparatus 129. For example, during the calibration process, the processor 142 iteratively receives and/or substantially simultaneously receives (e.g., every 50-milliseconds, every 5-seconds, between about 5-seconds and 60-seconds) a crank pulse count and/or pulse from the first sensor 128, a motor pulse count versus time and/or a pulse from the second sensor 130 and the position of the polished rod 110 versus time from the third sensor 132. In some examples, a timer 144 is used by the processor 142 and/or the first, second and/or third sensors 128, 130 and/or 132 to determine a sampling period and/or to determine when to request, send and/or receive data (e.g., measured parameter values) from the first, second and third sensors 128, 130 and 132. Additionally, in some examples, an input (e.g., sensor input, operator input) may be received by the I/O device 136 indicating when the crank arm 120 is vertical. The counterbalance torque may be at its minimum (e.g., approximately zero) when the crank arm 120 is vertical. Based on the input, the motor pulse count from a point in the cycle of the pumping unit 100 to the vertical position may be determined.

In some examples, the processor 142 generates a reference and/or calibration table 400 (FIGS. 4A and 4B) showing the relationship(s) between these measured parameter values (e.g., time, motor pulse count, and polished rod position) for a complete cycle(s) of the pumping unit 100 based on the position of the polished rod 110 versus time and the motor pulse count versus time between two consecutive crank pulse counts (e.g., a revolution of the crank arm 120). In some examples, time may be measured in seconds and the position of the polished rod 110 may be measured in inches.

Once the calibration process has completed and the corresponding reference table 400 has been generated, the determined position data (e.g., position of the polished rod 110 versus time data) is saved in the memory 140 and/or used by the processor 142 to generate a dynamometer card such as, for example, a rod pump dynamometer card, a surface dynamometer card, a pump dynamometer card, etc. The dynamometer cards may be used to identify the load, F, on the polished rod 110, for example. Additionally or alternatively, the values included in the reference table 400 may be used to determine the number of motors pulses per crank arm 120 revolution.

As shown in the reference table 500 of FIGS. 5A and 5B, the values of the reference table 400 of FIGS. 4A and 4B may be adjusted such that the measurements are based on a vertical position of the crank arm 120 and scaled to be associated with crank angular displacements (i.e., crank angle). In some examples, Equation 1 may be used to determine the crank angle based on values included in the reference table 400, where MP corresponds to the number of motor pules detected by the second sensor 130, MPPCZ corresponds to the number of motor pules detected by the second sensor 130 when the crank arm 120 is zero and MPPCR corresponds to the number of motor pules detected by the second sensor 130 during one revolution of the crank arm 120.

$$\text{Crank Angle} = \frac{2\pi(MP - MPPCZ)}{MPPCR} \qquad \text{Equation 1}$$

Equation 2 may be used to determine the torque created by the polished rod load, $T_{PRL}(\theta)$, when the crank arm 120 is at an angle, θ, where F corresponds to the polished rod load and $$\frac{ds(\theta)}{d\theta}$$

corresponds to the rate of change in the position of the polished rod 110 with respect to the change in the angle of the crank arm 120 (e.g., torque factor). Equation 3 may be used to determine the torque factor, $$\frac{ds(\theta)}{d\theta}, \quad \text{where } \frac{ds}{dt}$$

corresponds to the change in polished rod 110 position versus time (e.g., polished rod speed) and $$\frac{d\theta}{dt}$$

corresponds to the angular velocity of the crank arm 120. Specifically, in some examples and as shown in the reference table 600 of FIGS. 6A and 6B, a first order central difference approximation may be used to determine $$\frac{ds(\theta)}{d\theta} \text{ and } \frac{ds}{dt}$$

and the relationship shown in Equation 3 may be used to determine the torque factor, $$\frac{ds(\theta)}{d\theta}.$$

In some examples herein, the torque factor may be represented by $$TF(\theta) \text{ or } \frac{ds(\theta)}{d\theta}.$$

$$T_{PRL}(\theta) = F * \frac{ds(\theta)}{d\theta} \quad \text{Equation 2}$$

$$\frac{ds}{d\theta} = \frac{\frac{ds}{dt}}{\frac{d\theta}{dt}} \quad \text{Equation 3}$$

Equation 4 shows the relationship between the net torque, $T_{Net}(\theta)$, experienced by a shaft of the gear box 118 when the crank arm 120 is at an angle, θ, the counterbalance torque, $T_{CB}(\theta)$, when the crank arm 120 is at an angle, θ, and the torque, $T_{PRL}(\theta)$, from loading of the polished rod 110 when the crank arm 120 is at an angle, θ. In Equation 4, inertial torque of the pumping unit 100 is ignored. Equation 5 may be used to determine the net torque, $T_{Net}(\theta)$, on the gear box 118. Referring to Equation 5, $T_{NP}(\theta)$, corresponds to the motor torque, MPPCR corresponds to the number of motor 114 pulses recorded during one revolution of the crank arm 120 and Targets corresponds to the number of targets 134 coupled to the motor 114 and/or its shaft. In some examples, the motor torque is determined by a fourth sensor (e.g., a variable speed drive) 146 coupled to the motor 114. The net torque, $T_{Net}(\theta)$, on the gear box 118 may be represented in terms of inch pounds instead of foot pounds. Thus, the number twelve may be included in Equation 5 to represent the net torque in terms of inch pounds. Equation 6 shows the relationship between the counterbalance torque, $T_{CB}(\theta)$, at an angle, θ, the maximum counterbalance moment, M, and the phase angle, τ, of the counterbalance in radians.

$$T_{Net}(\theta) = T_{CB}(\theta) + T_{PRL}(\theta) \quad \text{Equation 4}$$

$$T_{Net}(\theta) = 12 * T_{NP}(\theta)\frac{MPPCR}{\text{Targets}} \quad \text{Equation 5}$$

$$T_{CB}(\theta) = -M * \sin(\theta + \tau) \quad \text{Equation 6}$$

Equation 7 represents a combination of Equations 2, 4 and 6 where $T_{Net}(\theta)$ corresponds to the net torque on the gear box 118 and/or its shaft, M corresponds to the maximum counterbalance moment, θ corresponds to the angular displacement of the crank arm 120 from vertical, τ corresponds to the phase angle of the counterbalance in radians, F corresponds to the instantaneous polished rod 110 load and TF(θ) corresponds to the torque factor at the crank arm 120 angle, θ.

$$T_{Net}(\theta)=[-M*\sin(\theta+\tau)]+F*TF(\theta) \quad \text{Equation 7:}$$

Equation 8 may be used to determine the phase angle of the counterbalance using the torque factors, $T_{Net}(\theta)$, at different crank angles. For example, using Equations 9, 10, 11 and 12, the respective torque factors may be determined when the crank angle is $$0, \frac{\pi}{2}, \pi \text{ and } \frac{3\pi}{2}.$$

In some examples, the torque factors between each of the crank angles $$0, \frac{\pi}{2}, \pi \text{ and } \frac{3\pi}{2}$$

may be interpolated. Equation 10 can also be rewritten to solve for the maximum counterbalance torque moment, M, as shown in Equation 13.

$$\tau = \text{atan}\frac{T_{Net}(\pi) - T_{Net}(0) + [F(0) * TF(0)] - [F(\pi) * TF(\pi)]}{T_{Net}\left(\frac{3\pi}{2}\right) - T_{Net}\left(\frac{\pi}{2}\right) + \left[F\left(\frac{\pi}{2}\right) * TF\left(\frac{\pi}{2}\right) - \left[F\left(\frac{3\pi}{2}\right) * TF\left(\frac{3\pi}{2}\right)\right]\right]} \quad \text{Equation 8}$$

$$T_{Net}(0) = [-M * \sin(\tau)] + F(0) * TF(0) \quad \text{Equation 9}$$

$$T_{Net}\left(\frac{\pi}{2}\right) = [-M * \cos(\tau)] + F\left(\frac{\pi}{2}\right) * TF\left(\frac{\pi}{2}\right) \quad \text{Equation 10}$$

$$T_{Net}(\pi) = [M * \sin(\tau)] + F(\pi) * TF(\pi) \quad \text{Equation 11}$$

$$T_{Net}\left(\frac{3\pi}{2}\right) = [M * \cos(\tau)] + F\left(\frac{3\pi}{2}\right) * TF\left(\frac{3\pi}{2}\right) \quad \text{Equation 12}$$

$$M = \frac{\left\{\left[F\left(\frac{\pi}{2}\right) * TF\left(\frac{\pi}{2}\right)\right] - T_{Net}\left(\frac{\pi}{2}\right)\right\}}{\cos(\tau)} \quad \text{Equation 13}$$

Figure 2:
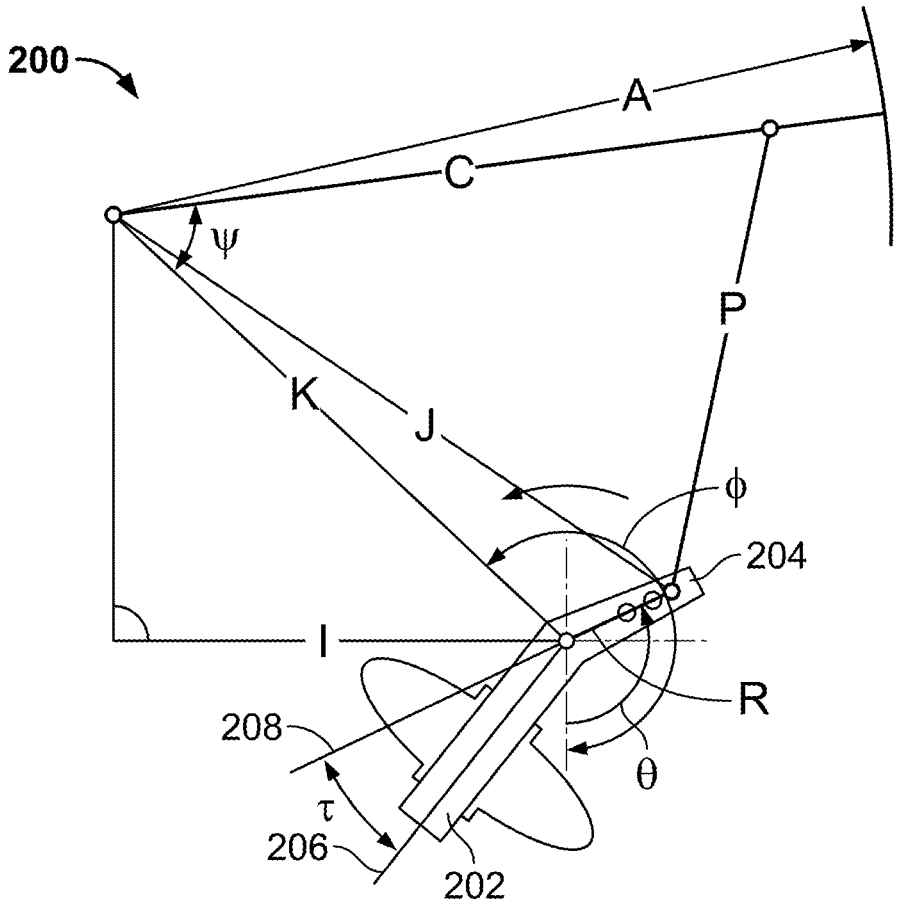
FIG. 2 is another example pumping unit for use with a well on which the examples disclosed herein can be implemented.

FIG. 2 shows a Mark II type pumping unit and/or pumping unit 200 that can be used to implement the examples the disclosed herein. In contrast to the crank arm balanced pumping unit 100 of FIG. 1 in which the pins of the crank arm 120 and the counterbalance share a common axis 148, the Mark II type pumping unit 200 includes a counterweight arm 202 and a pin arm 204 having offset axes 206 and 208. The offset axes 206 and 208 provide the pumping unit 200 a positive phase angle, τ.

Figure 3:
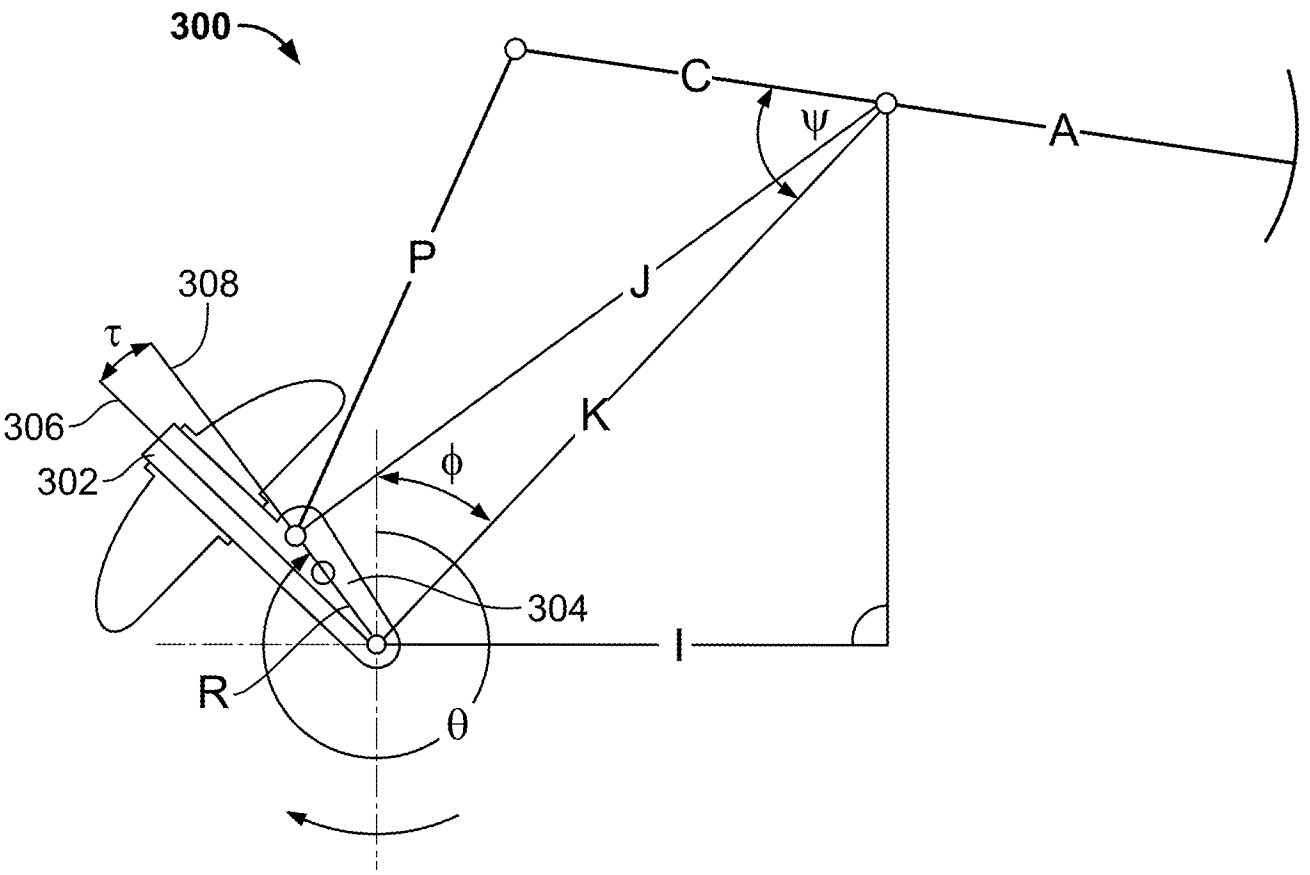
FIG. 3 is another example pumping unit for use with a well on which the examples disclosed herein can be implemented.

FIG. 3 shows an advanced geometry pumping unit and/or pumping unit 300 that can be used to implement the examples the disclosed herein. In contrast to the crank arm balanced pumping unit 100 of FIG. 1 in which the pins of the crank arm 120 and the counterbalance share the common axis 148, the advance geometry pumping unit 300 includes a counterweight arm 302 and a pin arm 304 having offset axes 306 and 308. The offset axes 306 and 308 provide the pumping unit 300 a negative phase angle, τ.

FIGS. 4A and 4B show the example reference table 400 that can be generated in connection with and/or used to implement the examples disclosed herein. The example reference table 400 includes first columns 402 corresponding to time received from and/or determined by the timer 144, second columns 404 corresponding to the pulse count of the motor 114 received from and/or determined by the second sensor 130 and third columns 406 corresponding to the position of the polished rod 110 received from and/or determined by the third sensor 132. In some examples, the data included in the reference table 400 relates to a single revolution of the crank arm 120.

FIGS. 5A and 5B show the example reference table 500 that can be generated in connection with and/or used to implement the examples disclosed herein. In some examples, the reference table 500 is generated by adjusting the values of the reference table 400 of FIGS. 4A and 4B such that the measurements are based on a vertical position of the crank arm 120 and scaled to be associated with crank angular displacements (i.e., crank angle in radians). The example reference table 500 includes first columns 502 corresponding to time received from and/or determined by the timer 144, second columns 504 corresponding to the pulse count of the motor 114 received from and/or determined by the second sensor 130, third columns 506 corresponding to the position of the polished rod 110 received from and/or determined by the third sensor 132 and fourth columns 508 corresponding to the crank angle.

FIGS. 6A and 6B show the example reference table 600 that can be generated in connection with and/or used to implement the examples disclosed herein. In some examples, the reference table 600 is generated using a first order central difference approximation to determine $$\frac{ds(\theta)}{d\theta} \text{ and } \frac{ds}{dt}$$

and the relationship shown in Equation 3 may be used to determine the torque factor, $$\frac{ds(\theta)}{d\theta}.$$

The example reference table 600 includes the first column 502 corresponding to time received from and/or determined by the timer 144, the second column 504 corresponding to the pulse count of the motor 114 received from and/or determined by the second sensor 130, the third column 506 corresponding to the position of the polished rod 110 received from and/or determined by the third sensor 132 and the fourth column 508 corresponding to the crank angle. The reference table 600 also includes a fifth column 602 corresponding to $$\frac{ds}{dt},$$

a sixth column 604 corresponds to $$\frac{d(\theta)}{dt}$$

and a seventh column 606 corresponds to $$\frac{ds}{d(\theta)}.$$

While an example manner of implementing the apparatus 129 is illustrated in FIG. 1, one or more of the elements, processes and/or devices illustrated in FIG. 1 may be combined, divided, re-arranged, omitted, eliminated and/or implemented in any other way. Further, the I/O device 136, the memory 140, the processor 142 and/or, more generally, the example apparatus 129 of FIG. 1 may be implemented by hardware, software, firmware and/or any combination of hardware, software and/or firmware. Thus, for example, any of the I/O device 136, the memory 140, the processor 142, the timer 144 and/or, more generally, the example apparatus 129 of FIG. 1 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example I/O device 136, the memory 140, the processor 142, the timer 144 and/or, more generally, the example apparatus 129 of FIG. 1 is/are hereby expressly defined to include a tangible computer readable storage device or storage disk such as a memory, a digital versatile disk (DVD), a compact disk (CD), a Blu-ray disk, etc. storing the software and/or firmware. Further still, the example apparatus 129 of FIG. 1 may include one or more elements, processes and/or devices in addition to, or instead of, those illustrated in FIG. 1, and/or may include more than one of any or all of the illustrated elements, processes and devices.

While FIG. 1 depicts a conventional crank-balanced pumping unit, the examples disclosed herein can be implemented in connection with any other pumping unit. For example, the example apparatus 129 and/or the sensors 128, 130, 132, and/or 146 may be implemented on the pumping unit 200 of FIG. 2 and/or the pumping unit 300 of FIG. 3.

Flowcharts representative of example methods for implementing the apparatus 129 of FIG. 1 are shown in FIGS. 7-10. In this example, the methods of FIGS. 7-10 may be implemented by machine readable instructions that comprise a program for execution by a processor such as the processor 1112 shown in the example processor platform 1100 discussed below in connection with FIG. 11. The program may be embodied in software stored on a tangible computer readable storage medium such as a CD-ROM, a floppy disk, a hard drive, a digital versatile disk (DVD), a Blu-ray disk, or a memory associated with the processor 1112, but the entire program and/or parts thereof could alternatively be executed by a device other than the processor 1112 and/or embodied in firmware or dedicated hardware. Further, although the example program is described with reference to the flowcharts illustrated in FIGS. 7-10 many other methods of implementing the example apparatus 129 may alternatively be used. For example, the order of execution of the blocks may be changed, and/or some of the blocks described may be changed, eliminated, or combined.

As mentioned above, the example methods of FIGS. 7-10 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example methods of FIGS. 7-10 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

Figure 7:
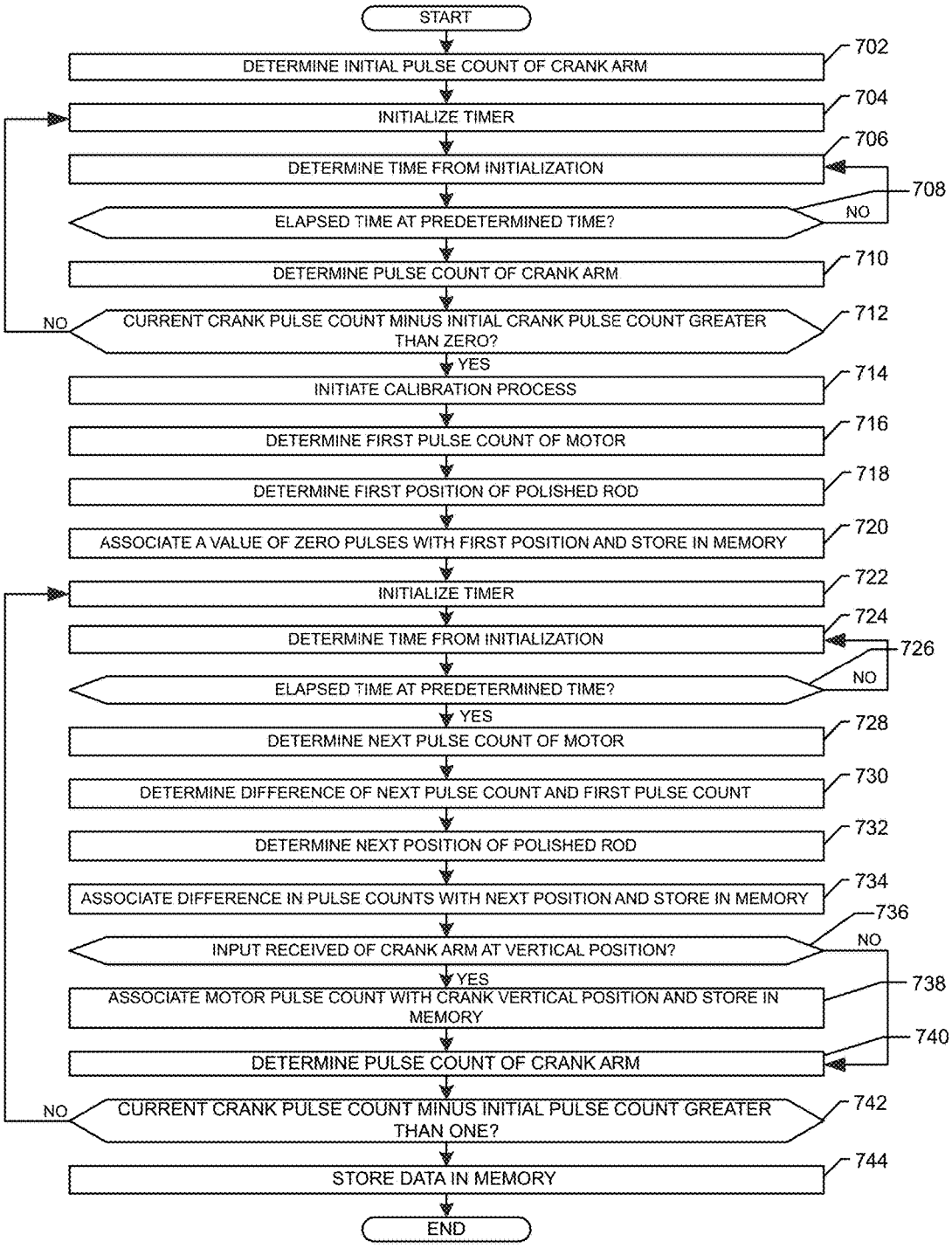
FIGS. 7-10 are flowcharts representative of example methods that may be used to implement the example pumping units of FIGS. 1-3.

The method of FIG. 7 may be used to generate the reference table 400 and begins in a calibration preparation mode that includes determining an initial pulse count of the crank arm 120 (block 702). At block 704, the processor 142 initiates and/or initializes the timer 144 (block 704). At block 706, the processor 142 determines, via the timer 144, the amount of time elapsed since the timer 144 was initialized (block 706). At block 708, the processor 142 determines if the elapsed time is at or after a predetermined time such as, for example, fifty milliseconds (block 708). The timer 144 may be used to set a sampling period and/or to substantially ensure data is obtained from the first, second and/or third sensors 128, 130, 132 at equal frequencies. If the processor 142 determines that the elapsed time is at or after the predetermined time, based on data from the first sensor 128, the processor 142 determines the pulse count of the crank arm 120 (block 710). At block 712, the processor 142 determines, based on data from the first sensor 128, if the difference between the current pulse count of the crank arm 120 and the initial pulse count of the crank arm 120 is greater than zero (block 712). In some examples, the pulse count of the crank arm 120 changes from zero to one once a cycle of the crank arm 120 has completed. In examples in which the pulse count begins at one, the processor 142 determines if the pulse count of the crank arm 120 has changed.

If the pulse count difference at block 712 is equal to zero, based on data from the first sensor 128, the processor 142 again initializes the timer 144 (block 704). However, if the pulse count difference at block 712 is greater than zero, the calibration process is initiated (block 714). At block 716, the second sensor 130 determines a first pulse count of the motor 114 (block 716). In other examples, immediately after the calibration process is initiated, the pulse count of the motor 114 is not obtained. At block 718, based on data from the third sensor 132, the processor 129 determines a first position of the polished rod 110 (block 718). The processor 142 then associates a value of zero pulses with the first position of the polished rod 110 and stores this data in the memory 140 (block 720). For example, the pulse count may be stored in a first entry 408 of the second column 404 of the reference table 400 and the first position of the polished rod 110 may be stored in a first entry 410 of the third column 406 of the reference table 400.

At block 722, the processor 142 again initiates and/or initializes the timer 144. At block 724, the processor 142 determines, via the timer 144, the amount of time elapsed since the timer 144 was initialized (block 724). At block 726, the processor 142 determines if the elapsed time is at or after a predetermined time such as, for example, fifty milliseconds (block 726). If the processor 142 determines that the elapsed time is at or after the predetermined time, based on data from the second sensor 130, the processor 142 determines a second and/or next pulse count of the motor 114 (block 728).

At block 730, the processor 142 determines the difference between the second and/or next pulse count and the first pulse count (block 730). At block 732, based on data from the third sensor 200, the processor 142 determines a second and/or next position of the polished rod 110 (block 732). At block 734, the processor 142 associates the difference between the first and second pulse counts with the second position and/or next position of the polished rod 110 and stores the data in the memory 140. For example, the pulse count difference may be stored in a second entry 412 of the second column 404 of the reference table 400 and the second position of the polished rod 110 may be stored in a second entry 414 of the third column 406 of the reference table 400. At block 736, the processor 142 determines if an input associated with the crank arm 120 being in a vertical and/or a zero position has been received (block 736). In some examples, the input may be an input received from an operator and/or a sensor that detects when the crank arm 120 is at the vertical and/or zero position. If an input is received regarding the crank arm 120 being in the vertical and/or zero position, the processor 142 associates the second or next pulse count with the crank arm 120 being in the vertical and/or zero position and stores this information in the memory 140 (block 738).

At block 740, based on data from the first sensor 128, the processor 142 determines the pulse count of the crank arm 120 (block 740). At block 742, the processor 142 determines if the difference between the current pulse count of the crank arm 120 and the initial pulse count of the crank arm 120 is greater than one (block 742). In some examples, the pulse count of the crank arm 120 changes if the crank arm 120 has completed a cycle. At block 744, the collected data, the generated reference table 400 and/or the processed data are stored in the memory 140 (block 744). The generated reference table 400 can be used in combination with data from the first and/or second sensors 128, 130 to determine the position of the polished rod 110 when the pumping unit 100 operates continuously. In some examples, the data included in the reference table 400 may be used to generate a dynamometer card that identifies the load, F, on the polished rod 110, for example. Additionally, the table 400 can be used to determine the net torque, $T_{Net}(\theta)$, experienced by the gear box 118, the counterbalance torque, $T_{CB}(\theta)$, when the crank arm 120 is at an angle, θ, and/or the torque, $T_{PRL}(\theta)$, due to the polished rod 110 when the crank arm 120 is at an angle, θ.

Figure 8:
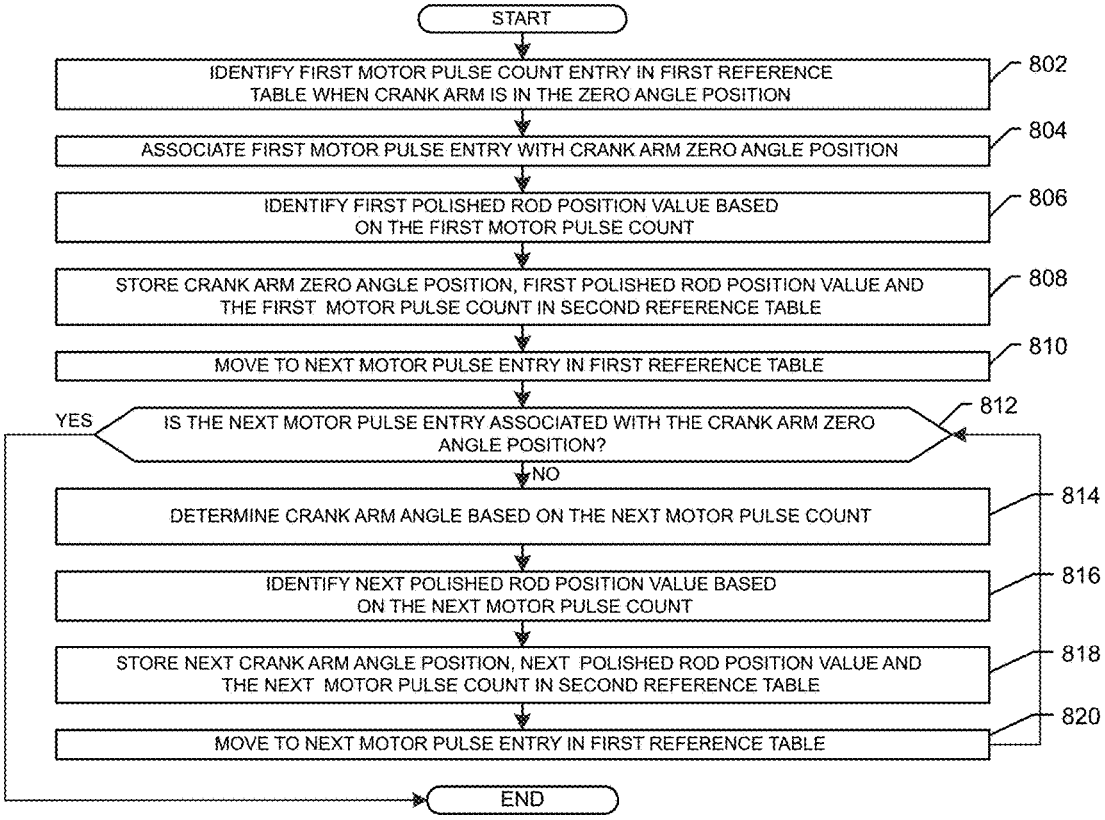

The method of FIG. 8 may be used to generate the reference table 500 and begins by the processor 142 identifying a first motor pulse entry in the reference table 400 that is associated with the crank arm 120 being in the vertical and/or zero angle position (block 802). The crank arm 120 may be associated with being in the vertical and/or zero position based on an input received by the processor 142. The input may be received from a sensor and/or an operator. In the the reference table 400 of FIGS. 4A and 4B, the crank arm 120 was identified as being in the zero angle position (e.g., vertical position) when the motor pulse count is at 800 at entry 416.

At block 804, the processor 142 associates the first motor pulse count entry with the crank arm 120 angle zero position (block 804). The processor 142 also identifies the first polished rod 110 position at entry 417 that is associated with the first motor pulse count (block 806). At block 808, the processor 142 stores the stores the crank arm 120 zero position at entry 510, the first polished rod 110 position at entry 512 and the first motor pulse count at entry 514 in the second reference table 500 (block 808).

At block 810, the processor 142 moves to the next motor pulse entry in the first reference table 400 (block 810). For example, if the next motor pulse entry is immediately after the first motor pulse entry, the processor 142 will move from entry 416 to entry 418. The processor 142 then determines if the next motor pulse entry is associated with the crank arm 120 zero angle position (block 812). In some examples, the next motor pulse entry is associated with the crank arm 120 zero angle position based on the crank arm 120 returning to the zero angle position after a full cycle. If the next motor pulse entry is associated with the crank arm 120 zero angle position, the method of FIG. 8 ends. However, if the next motor pulse entry is not associated with the crank arm 120 zero angle position, control moves to block 814.

At block 814, the processor determines the angle of the crank arm 120 based on the next motor pulse count entry (block 814). If the next motor pulse count entry is the first entry 408 in the reference table 400, the processor 142 may use Equation 14 to determine the angle of the crank arm 120. If the next motor pulse count entry is not the first entry 408 in the reference table 400, the processor 142 may use Equation 15 to determine the angle of the crank arm 120.

$$\text{Crank Angle} = 2\pi\frac{\text{motor pulses} + \text{motor pulses per crank stroke} - \text{motor pulses at crank arm zero position}}{\text{motor pulses per crank stroke}} \quad \text{Equation 14}$$

$$\text{Crank Angle} = 2\pi\frac{\text{motor pulses} - \text{motor pulses at crank arm zero position}}{\text{motor pulses per crank stroke}} \quad \text{Equation 15}$$

The processor 142 also identifies the next polished rod 110 position associated with the next motor pulse count (block 816). At block 818, the processor 142 stores the crank arm 120 next position at, for example, entry 516, the next polished rod 110 position at, for example, entry 518 and the next motor pulse count at, for example, entry 520 in the second reference table 500 (block 818). At block 820, the processor 142 moves to the next motor pulse entry in the first reference table 400 (block 820). For example, if the next motor pulse entry is immediately after the second motor pulse entry, the processor 142 moves from entry 412 to entry 420.

Figure 9:
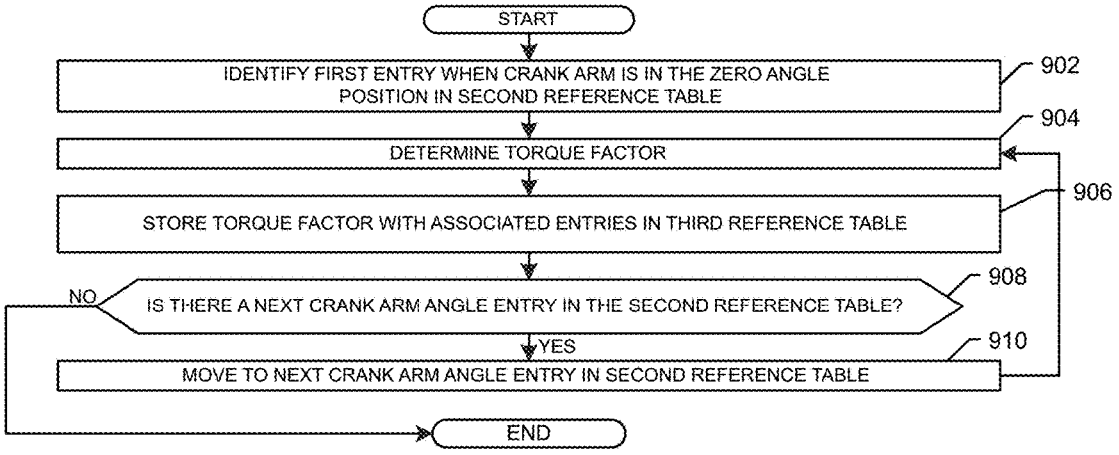

The method of FIG. 9 may be used to generate the reference table 500 and begins by the processor 142 identifying the first entry 608 in the reference table 500 when the crank arm 120 is in the vertical and/or zero angle position (block 902). At block 904, a torque factor is determined based on the associated crank arm 120 angle (block 904). In some examples, a first order central difference approximation may be used to determine $$\frac{ds(\theta)}{d\theta} \text{ and } \frac{ds}{dt}$$

and the relationship shown in Equation 3 may be used to determine the torque factor, $$\frac{ds(\theta)}{d\theta}.$$

The processor 142 then stores the $$\frac{ds}{dt}$$

in the associated entry in the fifth column 602, the $$\frac{d(\theta)}{dt}$$

in the associated entry in the sixth column 604 and the $$\frac{ds}{d(\theta)}$$

in the associated entry in the seventh column 606 (block 906).

The processor 142 then determines if the reference table 500 includes another crank arm 120 angle entry (block 908). For example, if the there are no more crank arm 120 angle entries (e.g., there are no subsequent crank arm 120 angle entries) the method of FIGS. 6A and 6B ends. However, if the next crank arm 120 angle entry is at entry 610, for example, the processor 142 then moves to the next crank arm 120 angle entry in the second reference table 500 and (block 910).

Figure 10:
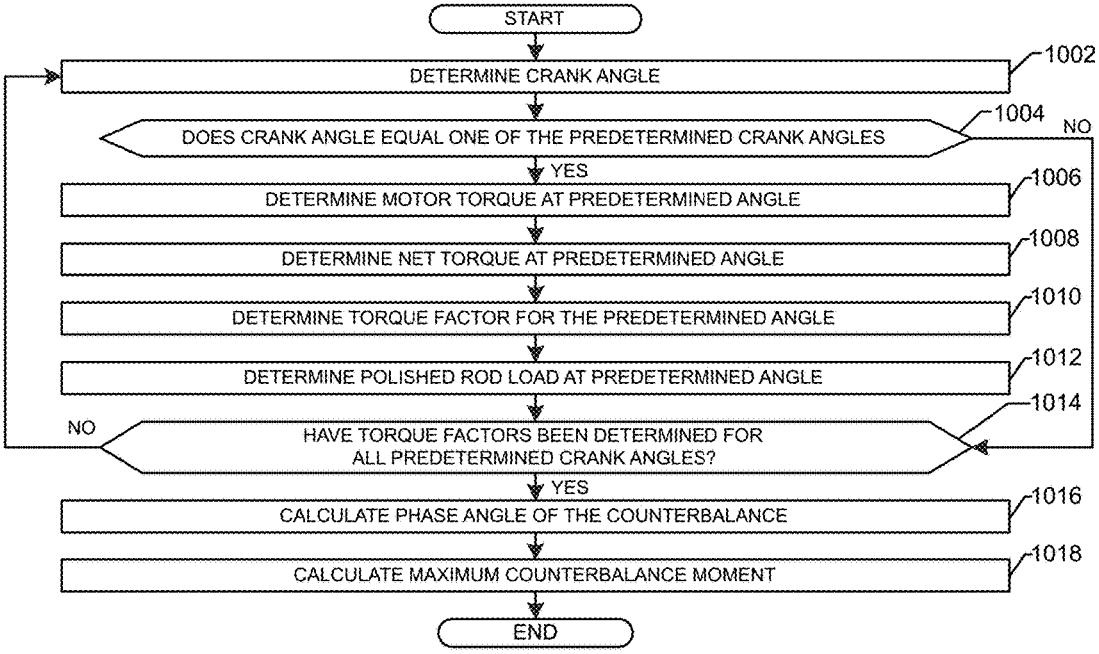

The method of FIG. 10 may be used to determine the phase angle, τ, of the counterbalance and/or the maximum counterbalance torque moment, M, and begins by the processor 142 determining the angle of the crank arm 120 using, for example, one or more of the reference tables 500, 600 and 700 and/or input from one or more of the sensors 128, 130, 132 and/or 146 (block 1002). The processor 142 then determines if the angle of the crank arm 120 is equal to one of the predetermined crank arm 120 angles (block 1004). In some examples, the predetermined crank arm 120 angles are $$0, \frac{\pi}{2}, \pi, \frac{3\pi}{2}.$$

If the crank arm 120 angle equals one of the predetermined crank arm 120 angles, the processor 142 determines a torque of the motor 114 at the predetermined angle using, for example, the fourth sensor 146 (block 1006). In some examples, the fourth sensor 146 is a variable speed drive (VSD). Based on the crank arm 120 angle equaling one of the predetermined crank arm 120 angles, the processor 142 determines the net torque, $T_{NP}$, experienced by the gear box 116 as a function of the angle of the crank arm 120 at the predetermined angle (1008). Based on the crank arm 120 angle equaling one of the predetermined crank arm 120 angles, the processor 142 determines the associated torque factor, TF(θ) by referring to the third table 600 (block 1010). Based on the crank arm 120 angle equaling one of the predetermined crank arm 120 angles, the processor 142 determines the load on the polished rod 110 using, for example, one or more of the reference tables 500, 600 and 700 (block 1012).

At block 1014, the processor 142 determines if the torque factors for each of the predetermined crank arm 120 angles have been determined. It not all of the torque factors for the predetermined crank arm 120 angles have been determined, the method of FIG. 10 returns to block 1002.

If all of the torque factors for the predetermined crank arm 120 angles have been determined, the processor 142 calculates the phase angle of the counterbalance using, for example, Equation 8 (block 1016). The processor 142 may then calculate the maximum counterbalance torque moment, M, using, for example, Equation 13 (block 1018). In some examples, to determine the phase angle and/or the maximum counterbalance torque moment, at least one stroke of the pumping unit 100 is monitored.

Figure 11:
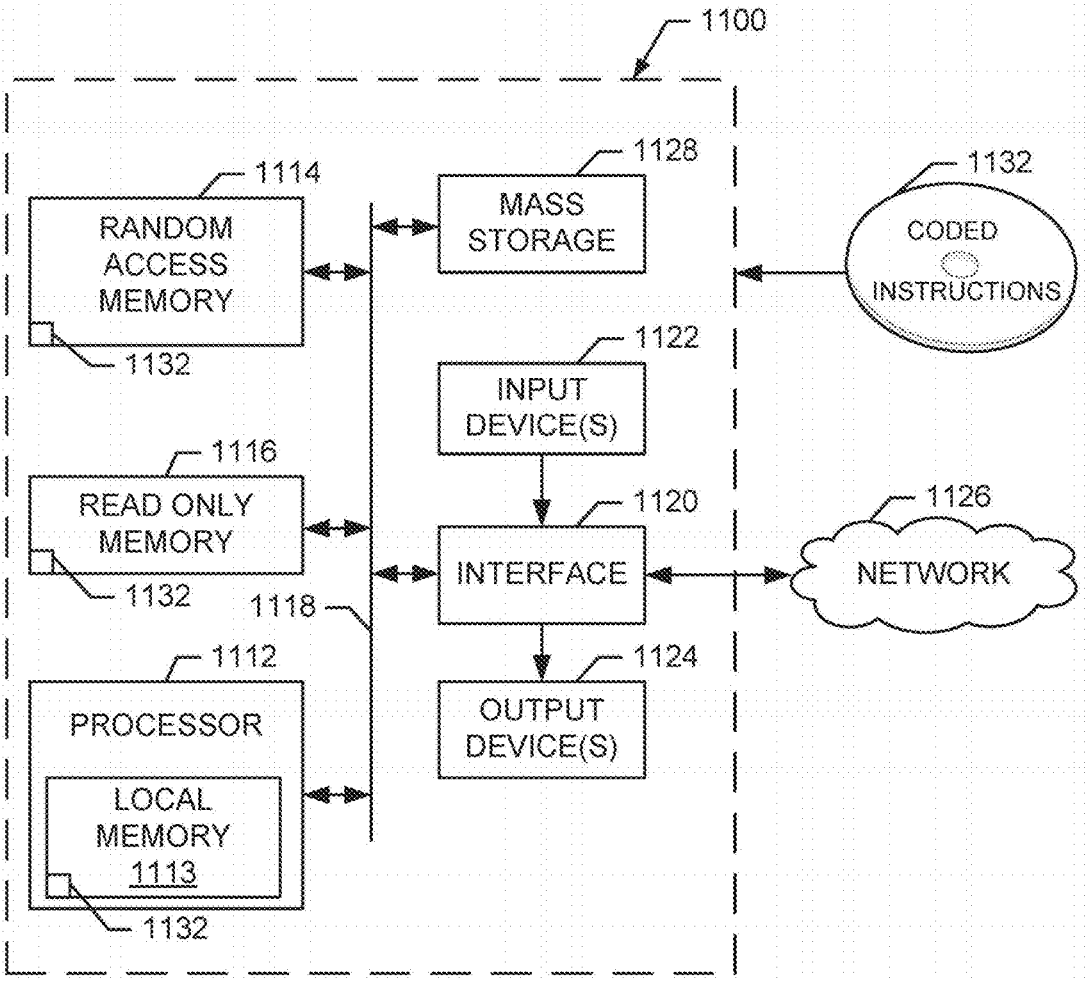
FIG. 11 is a processor platform to implement the methods of FIGS. 7-10 and/or the apparatus of FIGS. 1-3.

FIG. 11 is a block diagram of an example processor platform 1100 capable of executing the instructions to implement the methods of FIGS. 7-10 to implement the apparatus 129 of FIG. 1. The processor platform 1100 can be, for example, a server, a personal computer, a mobile device (e.g., a cell phone, a smart phone, a tablet such as an iPad™), a personal digital assistant (PDA), an Internet appliance, or any other type of computing device.

The processor platform 1100 of the illustrated example includes a processor 1112. The processor 1112 of the illustrated example is hardware. For example, the processor 1112 can be implemented by one or more integrated circuits, logic circuits, microprocessors or controllers from any desired family or manufacturer.

The processor 1112 of the illustrated example includes a local memory 1113 (e.g., a cache). The processor 1112 of the illustrated example is in communication with a main memory including a volatile memory 1114 and a non-volatile memory 1116 via a bus 1118. The volatile memory 1114 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1116 may be implemented by flash memory and/or any other desired type of memory device. Access to the main memory 1114, 1116 is controlled by a memory controller.

The processor platform 1100 of the illustrated example also includes an interface circuit 1120. The interface circuit 1120 may be implemented by any type of interface standard, such as an Ethernet interface, a universal serial bus (USB), and/or a PCI express interface.

In the illustrated example, one or more input devices 1122 are connected to the interface circuit 1120. The input device(s) 1122 permit(s) a user to enter data and commands into the processor 1012. The input device(s) can be implemented by, for example, an audio sensor, a microphone, a keyboard, a button, a mouse, a touchscreen, a track-pad, a trackball, isopoint and/or a voice recognition system.

One or more output devices 1124 are also connected to the interface circuit 1120 of the illustrated example. The output devices 1024 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 1120 of the illustrated example, thus, typically includes a graphics driver card, a graphics driver chip or a graphics driver processor.

The interface circuit 1120 of the illustrated example also includes a communication device such as a transmitter, a receiver, a transceiver, a modem and/or network interface card to facilitate exchange of data with external machines (e.g., computing devices of any kind) via a network 1126 (e.g., an Ethernet connection, a digital subscriber line (DSL), a telephone line, coaxial cable, a cellular telephone system, etc.).

The processor platform 1100 of the illustrated example also includes one or more mass storage devices 1128 for storing software and/or data. Examples of such mass storage devices 1128 include floppy disk drives, hard drive disks, compact disk drives, Blu-ray disk drives, RAID systems, and digital versatile disk (DVD) drives.

Coded instructions 1132 to implement the methods of FIGS. 7-10 may be stored in the mass storage device 1128, in the volatile memory 1114, in the non-volatile memory 1116, and/or on a removable tangible computer readable storage medium such as a CD or DVD.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A method, comprising:

determining a first load on a polished rod of a pumping unit;

estimating a first torque of a motor of the pumping unit;

determining a first torque factor for the pumping unit based on a correlation between a position of the polished rod and a pulse count value of the motor; and based on the first load, the first torque, and the first torque factor, determining a phase angle of a counterbalance of the pumping unit; and operating the pumping unit based on the phase angle to enable a net torque experienced by a gearbox of the pumping unit to satisfy a threshold.

2. The method of claim 1, further comprising determining a moment of the counterbalance.

3. The method of claim 1, wherein the first torque factor is determined using a reference table.

4. The method of claim 3, further including generating a dynamometer card based on the reference table.

5. The method of claim 3, further comprising:

moving the polished rod through a first cycle of the pumping unit using the motor;

determining first pulse count values of the motor through the first cycle using a first sensor at first times, the first times being substantially equally spaced;

determining first position values of the polished rod through the first cycle using a second sensor at the first times;

associating the first pulse count values with respective ones of the first position values to calibrate a processor of the pumping unit; and generating the reference table using the first pulse count values and the first position values obtained at the first times to show a correlation between the first pulse count values and the first position values.

6. The method of claim 5, further comprising determining a substantially zero-angle position of a crank arm and determining respective angles of the crank arm at the first position values.

7. The method of claim 1, wherein the first torque factor is associated with a first predetermined angle of a crank arm.

8. The method of claim 7, further comprising determining a second torque factor associated with a second predetermined angle of the crank arm, the phase angle being further determined based on the second torque factor.

9. The method of claim 1, further including adjusting the phase angle to a second phase angle and operating the pumping unit based on the second phase angle to enable the net torque experienced by the gearbox of the pumping unit to satisfy the threshold.

10. The method of claim 1, further including determining the net torque experienced by the gearbox based on an angle of a crank arm.

11. A method, comprising:

obtaining a predetermined grouping including pulse count values of a motor associated with respective ones of position values of a polished rod at respective time intervals during at least a first complete cycle of a pumping unit;

identifying a first group from the grouping, the first group including first pulse count values of the motor associated with a first position value of the polished rod at a first time;

determining a first crank angle of a crank arm associated with the first group;

determining a first rate of change value of the first position value associated with the first group based a second group selected from the grouping;

determining a first angular velocity value associated with the first crank angle based on the second group;

determining a first torque factor of the first group based on the first rate of change value and the first angular velocity value; and operating the pumping unit based on the first torque factor to enable a net torque experienced by a gearbox of the pumping unit to satisfy a threshold.

12. The method of claim 11, further comprising determining a first load on the polished rod of the pumping unit based on a correlation between the first pulse count values of the motor and the first position of the polished rod.

13. The method of claim 12, further comprising estimating a first torque of the motor of the pumping unit.

14. The method of claim 13, based on the first load, the first torque, and the first torque factor, determining a phase angle of a counterbalance of the pumping unit or a moment of the counterbalance based on the phase angle.

15. The method of claim 14, further comprising determining the other of the phase angle of the counterbalance of the pumping unit or the moment of the counterbalance.

16. The method of claim 11, wherein obtaining the predetermined grouping includes:

moving the polished rod through the at least the first complete cycle of the pumping unit using the motor;

determining the pulse count values of the motor through the first complete cycle using a first sensor at the respective time intervals, the respective time intervals being substantially equally spaced;

determining the respective ones of the position values of the polished rod through the at least the first complete cycle using a second sensor at the respective time intervals;

associating the first pulse count values with respective ones of the first position values to calibrate a processor of the pumping unit; and correlating the pulse count values with respective ones of the position values obtained at each of the respective time intervals to provide the predetermined grouping.

17. An apparatus, comprising:

a housing; and a processor positioned in the housing, the processor to:

determine a first load on a polished rod of a pumping unit;

estimate a first torque of a motor of the pumping unit;

determine a first torque factor for the pumping unit based on a correlation between a position of the polished rod and a pulse count value of the motor;

based on the first load, the first torque, and the first torque factor, determine a phase angle of a counterbalance of the pumping unit; and operate the pumping unit based on the phase angle to enable a net torque experienced by a gearbox of the pumping unit to satisfy a threshold.

18. The apparatus of claim 17, wherein the processor is to further determine a moment of the counterbalance.

19. The apparatus of claim 17, wherein the first torque factor is determined using a reference table.

20. The apparatus of claim 19, wherein the processor is to generate the reference table based on the correlation between the pulse count values of the motor using a first sensor and a position of the polished rod.

21. The apparatus of claim 17, wherein the first torque factor is associated with a first predetermined angle of a crank arm.

* * * * *